United States Patent [19]

Dörn

[11] 4,314,137

[45] Feb. 2, 1982

[54] ELECTRICALLY HEATED HAIR CURLING BRUSH

[75] Inventor: Klaus Dörn, Mülheim-Mintard, Fed. Rep. of Germany

[73] Assignee: Wik-Elektro-Hausgeräte-Vertriebsgesellschaft mbH Produktionskom-Manditgesellschaft, Essen, Fed. Rep. of Germany

[21] Appl. No.: 24,444

[22] Filed: Mar. 27, 1979

[30] Foreign Application Priority Data

Jan. 27, 1979 [DE] Fed. Rep. of Germany ..... 2903105

[51] Int. Cl.[3] ..... A46D 7/10; A45D 2/36; H05B 1/00

[52] U.S. Cl. ..... 219/222; 15/27; 15/159 R; 128/24.3; 132/9; 132/11 R; 132/33 R; 132/34 R; 132/85; 132/118; 132/122; 132/150; 219/244

[58] Field of Search ..... 219/222–226, 219/373, 244; 132/7, 9, 11 R, 11 A, 107, 117, 118, 121, 122, 123, 150, 151, 33 R, 33 A, 34 R, 34 A, 34 B, 34 C, 85; 15/21 R, 23, 25, 27, 159 R, 159 A; 128/24.1, 24.2, 24.3, 57; 38/100; 34/96, 101

[56] References Cited

U.S. PATENT DOCUMENTS

| | | | |
|---|---|---|---|
| 1,911,027 | 5/1933 | Marchand | 128/24.3 |
| 2,021,732 | 11/1935 | Lipsner | 128/24.3 |
| 2,507,373 | 5/1950 | Finkelstein | 132/120 |
| 2,627,861 | 2/1953 | Peyton | 132/34 R |
| 3,459,199 | 8/1969 | Connell | 132/11 R |
| 3,533,421 | 10/1970 | Mays | 132/11 A |
| 3,660,634 | 5/1972 | Scott | 132/118 |
| 3,909,868 | 10/1975 | Nogues | 15/27 |
| 3,935,423 | 1/1976 | Pucci | 219/225 |
| 3,947,910 | 4/1976 | Akerman | 132/34 R |
| 4,023,578 | 5/1977 | Buhler | 132/9 |
| 4,024,375 | 5/1977 | Olesen et al. | 132/34 R |
| 4,029,110 | 6/1977 | Hyland | 34/91 X |
| 4,032,747 | 6/1977 | Kunz | 219/225 X |
| 4,126,143 | 11/1978 | Schroeder | 132/11 A |
| 4,197,608 | 4/1980 | Holley et al. | 15/27 |

FOREIGN PATENT DOCUMENTS

| | | | |
|---|---|---|---|
| 867075 | 9/1978 | Belgium | 219/222 |
| 2502821 | 7/1976 | Fed. Rep. of Germany | 219/373 |
| 2526637 | 12/1976 | Fed. Rep. of Germany | 219/222 |
| 2742626 | 9/1977 | Fed. Rep. of Germany | 219/222 |
| 52-37152 | 3/1977 | Japan | 219/222 |
| 1548540 | 7/1979 | United Kingdom | 219/222 |

*Primary Examiner*—A. Bartis
*Attorney, Agent, or Firm*—Karl F. Ross

[57] ABSTRACT

An electrically heated hair curling brush for drying and styling hair includes an elongated handle having a longitudinal axis and provided at its front end with an axially extending inner tube affixed non-rotatably to the handle. An outer tube formed with a multiplicity of radial teeth defining a hair brush is engaged over the inner tube and supported for rotation about the longitudinal axis thereof by cooperating formations on the tube and handle. The cooperating formations include a circumferential rim on the front end of the handle defining a groove receiving and engaging a radially extending circumferential flange on the end of the outer tube adjacent the handle. A locking arrangement, including a radially displaceable spring-biased detent on the handle movable into engagement between radial locking teeth on the flange, is provided for selectively preventing rotation of the outer tube on the inner tube. An electric heating element is located within the inner tube whereby the outer tube is heated conductively through the inner tube. The other end of the outer tube is provided with a radially projecting handle whereby the outer tube can be manually rotated when the locking arrangement is disengaged.

10 Claims, 5 Drawing Figures

ELECTRICALLY HEATED HAIR CURLING BRUSH

FIELD OF THE INVENTION

The present invention relates to a device for drying and styling hair. More particularly this invention concerns such a device fashioned generally as a hairbrush and heated to aid in drying and styling wet hair.

BACKGROUND OF THE INVENTION

It is known, as for example from U.S. Pat. No 3,911,934, to dry and style hair by means of a brush connected via a conduit to a blowing and heating unit. In such an arrangement the blower and heater are jointly mounted in a separate stationary housing. It is also known to provide the blower and heater in a hand-held housing of the blow-dryer type, with a brush fitting on the nozzle of the dryer to allow styling of the hair while it is drying.

Such arrangements are invariably relatively bulky. It is necessary to provide a blower capable of moving a sufficient quantity of heater air, and it is also necessary to provide a relatively large heater capable of imparting to this air sufficient heat for the apparatus to dry and style hair effectively. Thus all such devices are bulky, relatively expensive because they incorporate considerable complex elements, and wasteful of energy.

Curling irons are also known which comprise an elongated metallic element provided internally with a conductive-type heater that serves to raise the surface temperature of the element sufficiently to set curls in hair wrapped around the end of the curling iron. Such devices operate at an elevated temperature and are invariably used on dry hair only, as the temperature of such a device would permanently damage wet hair wrapped around it. Furthermore such devices are only limitedly applicable for styling hair, serving only to set certain types of curls in dry hair. In addition, the construction of such devices makes them completely ineffective for drying hair.

Another hair-styling device is known which comprises a heater than raises the temperature of relatively massive rollers sufficiently that, when damp hair is wrapped around the hot rollers and these rollers are allowed to cool, curls can be set in the hair. Such a device is relatively slow-acting and thus can be used only for a complete hair-setting job, as the rollers cannot be heated up to very elevated temperatures since, on the one hand, they are to be used on wet hair and will remain in contact therewith for a considerable time and, on the other hand, they must be cool enough so that they can be picked up and emplaced by hand.

OBJECTS OF THE INVENTION

It is therefore an object of the present invention to provide an improved hair drying and styling device.

Another object is the provision of such a device which overcomes the various disadvantages of the above-described known systems.

A further object of this invention is to provide a hair drying and styling device which is easy to use, compact in shape, and safe for use on wet hair.

SUMMARY OF THE INVENTION

These objects are attained according to the instant invention in a hair drying and styling device having an elongated housing acting as a handle and defining a longitudinal axis between a front housing end and a rear housing end. A rigid inner tube is fixed to the housing and extends axially away from the front housing end. An outer tube is engaged over this inner tube and is formed as a hairbrush. Formations on the inner and outer tubes are provided for rotation of the outer tube on the inner tube about its axis. Locking means is provided on the housing displaceable between a locking position preventing rotation of the outer tube on the inner tube about the axis and a freeing position permitting this rotation. A conductive-type heater is provided in the inner tube in heat-transmitting engagement therewith and through this inner tube with the outer tube. A wire extends through the housing to the heater for electrically energizing same and thereby conductively heating the tubes. The device according to this invention can therefore use a relatively compact and inexpensive conductive-type heater which is mounted in the end of the device and which can be constructed so as to maintain an extremely even temperature at a level sufficiently high to dry hair contacting the outer tube, but still low enough to prevent damage to wet hair. The use of bulky blowers and high-wattage heaters is completely avoided.

The possibility of rotating the brush on the heated core, aided in accordance with another feature of this invention by the provision of an unheated handle or knob at the outer end of the brush, allows the device to be used for many different kinds of styling. Thus curls can easily be set simply by actuating the locking means to rotationally free the outer brush and then turning same with one hand while it is held in engagement with a tress of hair, so as to wind the tress up about the outer brush tube.

According to further features of this invention the formations between the inner and outer tubes, which are both substantially cylindrical, include a cylindrical ridge on one of the tubes adjacent the housing directed toward and engaging the other tube, and an axially outwardly projecting small-diameter pin on the outer end of the inner tube engaged in a complementarily dimensioned collar on the outer tube. Thus the outer tube can rotate easily on the inner tube, but is very closely juxtaposed therewith so as to be in excellent heat-transmitting relationship therewith.

According to still further features of this invention the two tubes are made of the same material, a heat-resisting polyamide such as nylon reinforced with glass fibers being advantageous. The use of the same material for both tubes ensures that their coefficients of thermal expansion will be the same so that when the device heats up the two tubes will not bind on each other. The handle at the end of the outer tube can be made of a heat-resistant but less conductive synthetic resin such as a polycarbonate, so that the user's fingers will not be burned.

According to another feature of this invention the housing is formed with a collar that engages over an outwardly extending ridge or flange on the outer tube. This flange is in turn formed with teeth engageable by a detent forming part of the locking means. A spring urges the detent into a position engaging between teeth of the outer tube, so that normally the outer tube cannot rotate relative to the inner tube. Thus the user can wind up a tress in either of two ways: by leaving the outer tube fixed on the housing and rotating the entire iron, or by freeing the outer tube for rotation and rotating it on the inner tube by means of the knob at the end. To unwind a curl the user need merely depress the detent to free the outer tube and then pull the device away, with the tress automatically unwinding from the outer tube. The above-described operations are facilitated when a swivel connection is provided for the electrical feed line at the far axial end of the housing, so that rotating the entire device about its axis will not tangle the cord.

SPECIFIC DESCRIPTION

Figure 1:
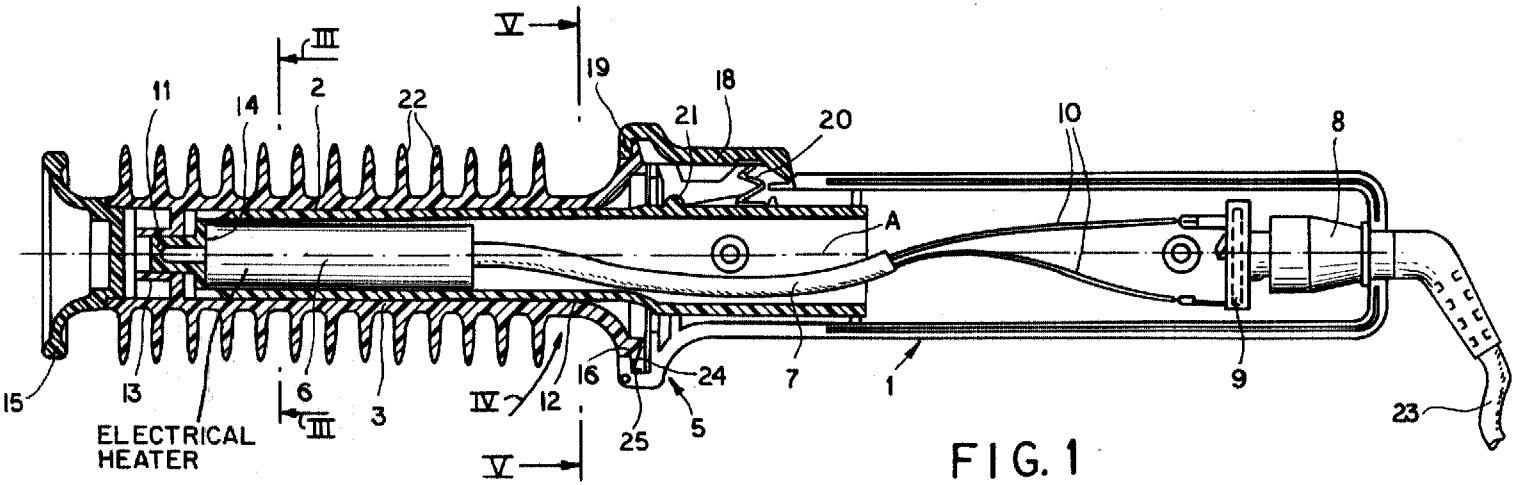
FIG. 1 is an axial section through the device according to this invention.
Figure 3:
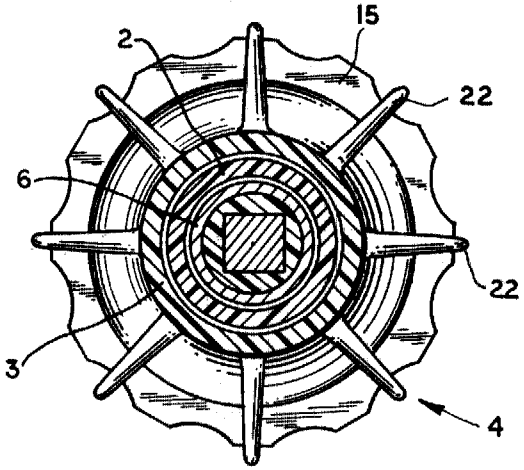
FIG. 3 is a large-scale section taken along line III—III of FIG. 1.
Figure 2:
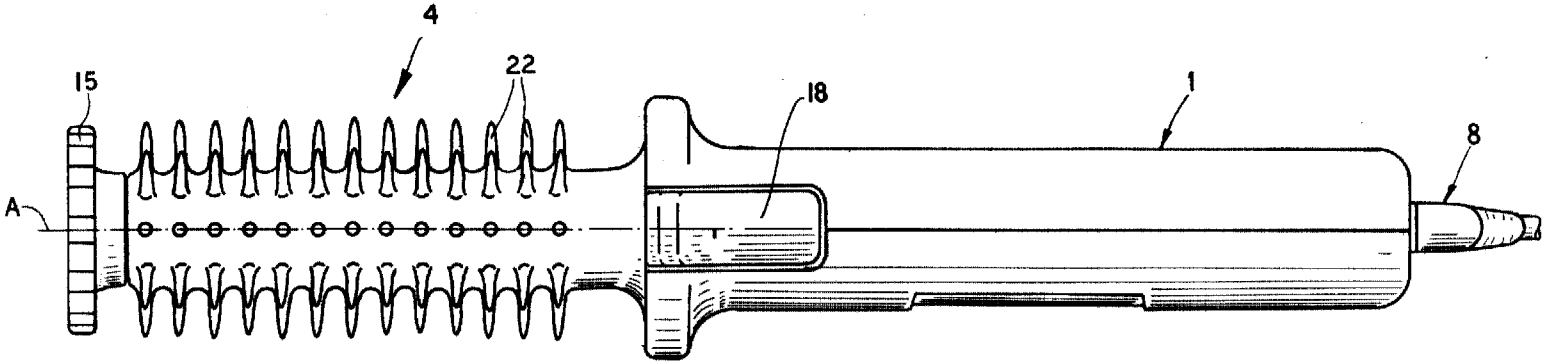
FIG. 2 is a top view of the device of FIG. 1.

As shown in the drawing the hair-styling and -drying device according to this invention basically comprises a cylindrical handle or housing 1 formed of a pair of spectrally identical halves united in the plane of the drawing in FIG. 1 and in a plane perpendicular to the drawing in FIG. 2. Secured to this handle 1 is a generally cylindrical inner tube 2 having an axis A which corresponds to the axis of the handle. An outer tube 3, formed with spikes 22 that could be replaced by brush tufts, forms a brush 4. A coupling 5 secures the brush 4 to the device, centered on the axis A.

Provided inside the inner tube 2, held in place by means of a heat-conductive epoxy adhesive, is a cylindrical cartridge-type heater 6 having a cable 7 whose conductors 10 extend back into the handle 1 to a contact strip 9 mounted on a swivel coupling 8 that leads axially out of the back end of the handle 1. Thus the entire device can rotate about the axis A relative to a line cord 23 without tangling or knotting this line cord.

Figure 4:
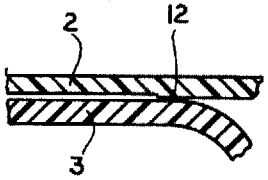
FIG. 4 is a large-scale view of the detail indicated at IV in FIG. 1.
Figure 5:
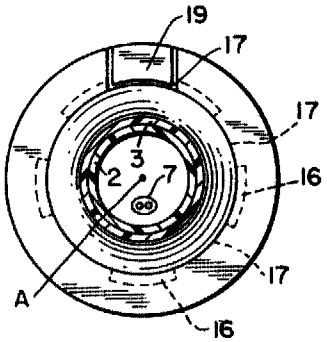
FIG. 5 is a section taken along line V—V of FIG. 1.

The inner tube 2 is formed like the outer tube 3 of a polyamide reinforced with glass fibers. This tube 2 has an end wall 14 perpendicular to the axis A and formed with an axially outwardly projecting cylindrical pin 11 centered on the axis A. The inner tube 2 is also formed, as shown in FIG. 4, with a cylindrical outwardly projecting ridge 12. The outer tube 3 rides adjacent to the housing 1 on this ridge 12 and is formed with a collar 13 engaging over the pin 11. Thus the collar 13 and pin 11 at one end and the formation 12 riding on the inner surface of the tube 3 at the other end firmly support the tube 3 on the tube 2, while allowing the tubes to rotate relative to each other.

The outer end of the outer tube 3 is provided with an outwardly extending wheel-type knob or handle 15. This element 15 is made of a less conductive but heat-resistant synthetic resin such as a polycarbonate. At its other end the tube 3 is formed centered on the axis A with an array of outwardly directed square teeth 16 and with an outwardly directed flange 24 received within an inwardly open groove or recess 25 of the housing 1. Engagement of the flange 24 within the groove 25 thus prevents relative axial displacement of the tubes 2 and 3. A detent 18 pivoted at 21 on the inner tube 2 has a tip 19 engageable in notches 17 formed between adjacent teeth 16. A compression spring 20 engages between the detent 18 and the tube 2 to urge it normally into a position with its tip 19 engaged in a notch 17, in which position rotation of the tube 3 relative to the tube 2 is impossible.

The device according to this invention is meant for use in simultaneously drying and styling hair. The heater 6 is so constructed as to maintain a temperature sufficiently high to be effective for drying and styling, but not so very high as to damage wet hair. The user holds the handle 1 in his or her hand and winds up hair on the brush 4 either by rotating the entire device or by by depressing the detent button 18 and rotating the tube 3 by means of the wheel 15. It is also possible simply to stroke the device through the hair in the manner of a conventional hairbrush.

The device according to this invention is extremely effective and easy to use. It can be produced at relatively low cost and consumes a relatively modest amount of electricity, as the heater 6 is so effectively placed that it can be of relatively small wattage, and no blower whatsoever need be provided. The provision of the optionally rotatable brush 4 makes various styling operations extremely easy to carry out.

I claim:

1. A device for drying and styling hair, said device comprising:

an elongated housing defining a longitudinal axis and having a front housing end and a rear housing end;

an inner tube fixed nonrotatably to said housing and extending axially from said front housing end;

an outer tube engaged over said inner tube, having an end close to said housing formed with an array of radially directed teeth and formed as a hairbrush;

means including cooperating formations on said tubes and housing for rotation of said outer tube on said inner tube about said axis, one of said formations being a circumferential rim formed on said housing and engaging around said teeth;

locking means including a detent on said housing displaceable radially between a locking position engaging between said teeth and preventing rotation of said outer tube on said inner tube about said axis and a freeing position clear of said teeth and permitting such rotation;

an electrical heater fixed in said inner tube and in heat-transmitting engagement therewith and therethrough with said outer tube; and means including a wire extending through said housing and to said heater for electrically energizing same and thereby conductively heating said tubes.

2. The device defined in claim 1 wherein said inner and outer tubes are substantially imperforate, whereby heat can only be transmitted from said heater to said outer tube by conduction through said inner tube.

3. The device defined in claim 2 wherein said tubes are formed of a glass-reinforced polyamide.

4. The device defined in claim 2 wherein said outer tube has an end remote from said housing provided with a radially projecting unheated handle, whereby said outer tube can be rotated on said inner tube by means of said handle in said freeing position of said locking means.

5. The device defined in claim 2 wherein said outer tube is formed remote from said housing with a multiplicity of radially extending fingers defining said hairbrush.

6. The device defined in claim 1 wherein said locking means includes a spring urging said detent into said locking position engaged between said teeth.

7. The device defined in claim 1 wherein said inner tube is formed with a fulcrum, said detent being pivotal on said fulcrum about a pivot axis spaced from and generally perpendicular to said axis of said housing.

8. The device defined in claim 1 wherein said detent is pivotal on said inner tube about a detent axis and has to one side of said detent axis a tip engageable in a radial inner position between said teeth, said locking means including a spring braced between said detent and said inner tube and urging said tip into said radial inner position and urging said detent to the other side of said detent axis radially outwardly.

9. A device for drying and styling hair, said device comprising:

an elongated housing defining a longitudinal axis and having a front housing end and a rear housing end;

a substantially imperforate inner tube fixed nonrotatably to said housing and extending axially from said front housing end a substantially imperforate outer tube engaged over said inner tube and formed as a hairbrush;

means including cooperating formations on said tubes for rotation of said outer tube on said inner tube about said axis, said formations including an annular rib centered on said axis and formed on said inner tube adjacent said housing, an axially projecting and centered pin formed on said inner tube remote from said housing, and a collar formed on said outer tube and engaged around said pin;

locking means on said housing displaceable between a locking position preventing rotation of said outer tube on said inner tube about said axis and a freeing position permitting such rotation;

an electrical heater fixed in said inner tube and in heat-transmitting engagement therewith and therethrough with said outer tube, whereby heat can only be transmitted from said heater to said outer tube by conduction through said inner tube; and means including a wire extending through said housing and to said heater for electrically energizing same and thereby conductively heating said tubes.

10. The device defined in claim 9 wherein said inner tube has an end remote from said housing formed with an end wall carrying said pin, said heater engaging said end wall.

* * * * *